US006092365A

United States Patent [19]

Leidel

[11] Patent Number: 6,092,365

[45] Date of Patent: Jul. 25, 2000

[54] HEAT ENGINE

[76] Inventor: James A. Leidel, 18295 Aspen Trail, Brownstown Township, Mich. 48174

[21] Appl. No.: 09/028,165

[22] Filed: Feb. 23, 1998

[51] Int. Cl.[7] ..... F02G 3/02

[52] U.S. Cl. ..... 60/39.63

[58] Field of Search ..... 60/39.6, 39.63

[56] References Cited

U.S. PATENT DOCUMENTS

| | | | |
|---|---|---|---|
| 125,166 | 4/1872 | Brayton . | |
| 1,510,688 | 10/1924 | La Fon | 60/39.63 |
| 3,520,132 | 7/1970 | Warren | 60/39.63 |
| 3,651,641 | 3/1972 | Ginter | 60/39.63 |
| 3,708,976 | 1/1973 | Berlyn | 60/39.63 |
| 3,775,973 | 12/1973 | Hudson . | |
| 3,811,271 | 5/1974 | Sprain | 60/39.6 |
| 3,839,858 | 10/1974 | Van Avermaete | 60/39.6 |
| 4,149,370 | 4/1979 | Vargas | 60/39.6 |
| 4,212,162 | 7/1980 | Kobayashi | 60/39.63 |
| 4,653,269 | 3/1987 | Johnson | 60/39.63 |
| 4,756,377 | 7/1988 | Kawamura et al. | 60/608 |

FOREIGN PATENT DOCUMENTS

| | | | |
|---|---|---|---|
| 6353 | 4/1915 | United Kingdom | 60/39.63 |

OTHER PUBLICATIONS

Leidel, James, "An Optimized Low Heat Rejection Engine for Automotive Use—An Inceptive Study," SAE Paper 970068 (1997).

*Primary Examiner*—Michael Koczo

[57] ABSTRACT

A heat engine is optimized for maximum efficiency for use as an automotive powerplant. The engine is composed of a separate variable induction compressor, a compressed air accumulator, a combustor, and a separate expander. The engine is designed to minimize heat losses following compression, minimize system parasitic losses, and utilize high combustion temperatures. The expander is constructed to minimize mechanical stresses and facilitate the use of structural ceramic materials.

5 Claims, 6 Drawing Sheets

*Engine Control Schematic*

Heat Engine Schematic

Heat Engine Schematic with Cutaway Sections

Fuel Injection
Detail

Crosshead Shaft
Seal Detail

Engine Control
Schematic

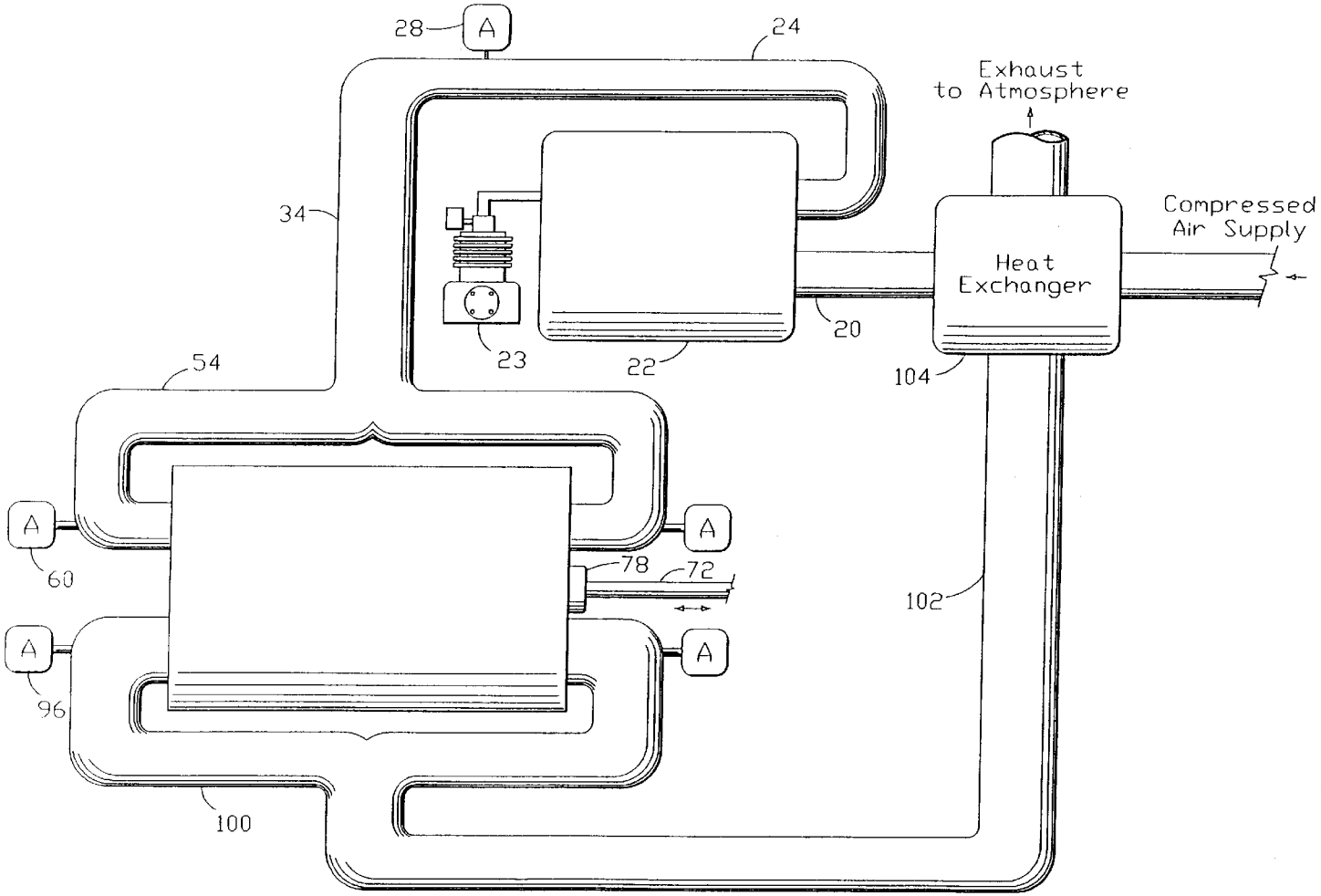
*Figure 4 Partial Heat Engine Schematic with Exhaust Gas Heat Recovery*

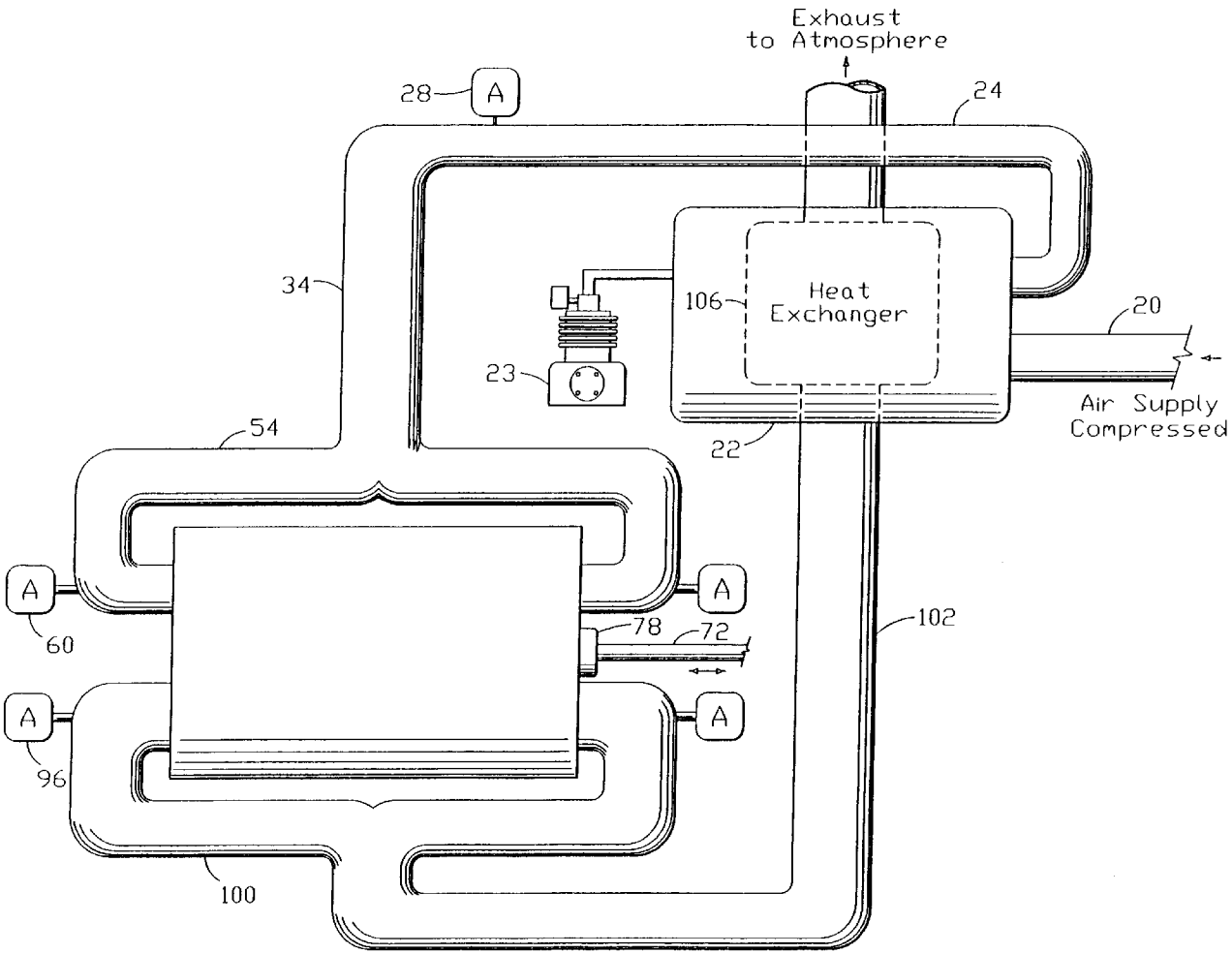
*Figure 5 Partial Heat Engine Schematic with Exhaust Gas Heat Recovery within the Accumulator*

HEAT ENGINE

BACKGROUND

1. Field of Invention

This invention relates to heat engines similar in design to earlier "hot air" engines. These engines produce a motive power from compressed air. A compressor section produces compressed air to be combusted, with a suitable fuel, externally of a separate positive displacement expansion device.

2. Discussion of Prior Art

The term "heat engine" is used to describe a machine which produces useful work from the combustion of a flammable fuel and air mixture. Among the most successful are the modern gasoline fueled two and four stroke spark-ignition engine, the two and four stroke oil fueled compression-ignition engine, and the gas turbine engine.

This invention more closely resembles the past "hot-air" engines. These designs utilize combustion prior and external to the power producing expansion device, such as a reciprocating piston or rotating turbine wheel. Many of the components of this invention have been included in previous patents, but the lack of several key elements as well as the lack of a proper conceptual framework has prevented each from achieving significant commercial success.

One of the earliest, and most successful, of the related works is shown in U.S. Pat. No. 125,166 to Brayton (1872). His engine consists of integral compression and expansion pistons within a common cylinder body. Fuel and air are mixed prior to compression, producing a potentially dangerous, pressurized mixture. The ratio of compression to expansion was fixed, therefore, the engine is more suitable for a constant power application. Due to the limitations of controls and materials of the day, as well as the competition from the internal combustion engine, Brayton's gas engine disappeared from use. Nevertheless, the power cycle he pioneered, in which combustion theoretically occurs at a constant pressure, still bears his name.

Due to the petroleum shortages in the 1970's, as well as an increasing problem of automotive air pollution, there was a resurgence of interest in the "external combustion" designs. One such design is described by U.S. Pat. No. 3,775,973 to Hudson (1973). Unfortunately, it lacks a compressed air accumulator, and becomes overly complicated with its two stage, compound compression and expansion pistons.

U.S. Pat. No. 3,811,271 to Sprain (1974) and U.S. Pat. No. 3,839,858 to Avermaete (1974) each illustrate an improved powerplant. Both suffer from a few of the same major disadvantages of earlier attempts. One such problem is an inadequately sized, or absent, compressed air accumulator. Another is an integral compression and expansion engine cylinder block which transfers the heat of combustion to the induction components, reducing volumetric efficiency, or efficiency of air flow.

A further improved engine is described by U.S. Pat. No. 4,149,370 to Vargas (1979). Even though Vargas includes more of the essential components, his engine cools the compressed air charge during storage in the accumulator, reducing cycle efficiency. Further, he states that temperatures will be maintained at levels low enough to facilitate the use of conventional materials. This necessitates an undesirable engine cooling system.

The most advanced design was put forth in U.S. Pat. No. 4,653,269 to Johnson (1987). His design includes the complication of a variable transmission between the compression and expansion devices. Also, in addition to being undersized, the accumulator is not permanently installed in the fluid flow path, but is selectively connected upon demand.

In all of the above designs, no provisions are made to accommodate the high temperature combustion products which will be in contact with the valves, pistons, and cylinders. The use of conventional materials necessitates the cooling of various engine components and often the compressed air supply. Any heat removed must only be reintroduced during the combustion process, thereby lowering the thermodynamic cycle efficiency. And lastly, while several of the above designs incorporate a compressed air accumulator, they are undersized and fail to take full advantage of the torque reserve and operating characteristics of a properly sized unit.

The last reference to be cited is SAE technical paper number 970068 by Leidel (1997). The paper was written by this inventor for the purpose of desribing an inceptive study which produced this invention. It also includes research and discussion of material and tribological issues.

OBJECTS AND ADVANTAGES

To be effective, an automotive powerplant must be able to perform with maximum utility and efficiency during "real life" operation. Of prime importance is the typical driving cycle, to which it will be applied. This cycle is a mix of part load cruising, acceleration, and an ever increasing amount of urban stop and go operation. Such a powerplant must be easily marketable, or despite its advantages, it will fail to be utilized by the public. Therefore, the power system must not only be designed for maximum efficiency, but must perform in a manner most pleasing to its intended operator. Among these desirable criteria are,

- Quiet operation
- Smooth operation, lacking in vibration
- Quick response to control input
- Ample torque and power
- High reliability and durability
- Ease of operation and maintenance Additionally, the design criteria should include characteristics making it economically viable to produce and then maintain while in service:

- Simple in design
- Manufactured from economical materials by economical methods
- Modular in construction for ease of repair
- Compact for flexible placement in small engine compartments And most importantly, the design criteria should include characteristics required by the modern automobile's prominent role in our society and by the challenges we face with our environment:

- Multi-fuel capable
- Highly fuel efficient
- Low in emissions of incomplete combustion products and harmful byproducts These desirable characteristics have been stressed in differing degrees throughout the evolutionary process of our modern automotive powerplant. In addition to engineering factors, many political, social, and economic elements have contributed with equal weight to the domination of the internal combustion engine.

This patent describes an original undertaking to design a heat engine specifically for use in an automobile. While a thorough study of the history of automotive development as well as the present state of the art is integral to this endeavor, no preconceived constraints were imposed other than the above criteria. Nothing was imposed which would favor any one type of conventional design. This invention is based on a comprehensive study of the history of successful designs, the current state of the art, advances in material technology, the desires of the operator, all of which are summarized by the following engineering goals:

a. Thermodynamic efficiency
   - Combustion temperatures as high as practical (constrained by material and emission limitations)
   - Continuous, controlled combustion with excess air for complete fuel utilization b. Volumetric efficiency, or the efficiency of air flow
   - Low temperatures in the air intake/compression process to maintain a low intake air density
   - Minimal restrictions to air flow throughout the power plant
   - Minimal pumping losses c. Mechanical efficiency
   - Low friction
   - Minimal parasitic loses from auxiliary devices d. Compatibility with typical automotive power needs
   - High torque at low speeds, less at high speeds
   - Efficient at part load operation e. Simple in manufacture and easy to repair
   - Simple power transmission requirements
   - Simple and perhaps modular in design
   - Constructed of readily available materials
   - Constructed by simple manufacturing processes These goals were adhered to throughout the design process. The following are the physical embodiments of these goals:

- Utilization of the highest practical temperature of combustion in conjunction with high temperature structural ceramic materials
- Utilization of a controlled, continuous combustion process with excess air
- Use of compression, stored energy, and constant pressure combustion external of the expansion device for smooth, responsive torque delivery
- Stored energy for instantaneous reserve power capacity and a favorable torque response versus engine speed
- Enhanced volumetric efficiency through relatively low temperature induction components due to separate compression and combustion devices
- Increased part load efficiency by reducing part load compression pumping loads
- Utilization of regenerative braking
- Elimination of several system parasitic losses as compared to conventional powerplants
- Adaptable to a variety of fuels
- Adaptable to exhaust gas heat recovery

LIST OF DRAWING FIGURES

FIG. 4 is a partial schematic of the heat engine with the addition of an exhaust gas heat exchanger.

FIG. 5 is a partial schematic of the heat engine in which the accumulator contains an exhaust gas heat exchanger.

Figure 1:
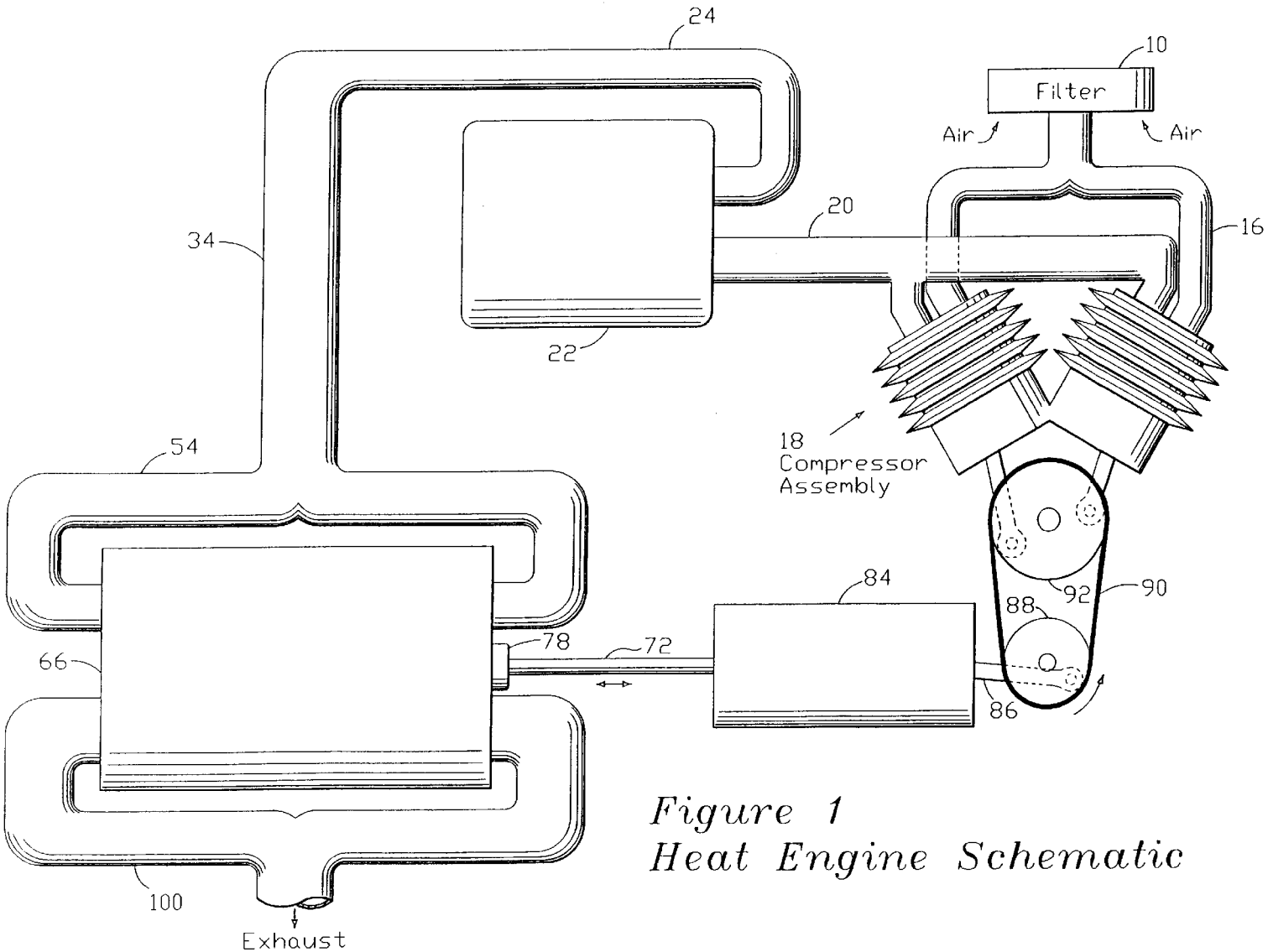
FIG. 1 is a schematic illustration of the basic heat engine components.

List of Reference Numerals Used in Figures

| | | | |
|---|---|---|---|
| 10 | Intake air filter | 72 | Crosshead shaft |
| 12 | Induction valve | 74 | Right cylinder head |
| 14 | Induction valve actuator | 76 | Packing gland |
| 16 | Compressor induction manifold | 78 | Packing nut |
| 18 | Compressor | 80 | Packing spring |
| 20 | Compressed air supply manifold | 82 | Crosshead |
| 22 | Accumulator | 84 | Crosshead cylinder |
| 23 | Auxiliary compressor | 86 | Connecting rod |
| 24 | Compressed air line | 88 | Main crankshaft |
| 26 | Throttle valve | 90 | Compressor drive chain |
| 28 | Throttle valve actuator | 92 | Compressor crankshaft |
| 30 | Burner | 94 | Exhaust valve |
| 32 | Secondary air passage | 96 | Exhaust valve actuator |
| 34 | Combustion chamber | 98 | Exhaust valve spring |
| 36 | Electronic ignition module | 100 | Exhaust manifold |
| 38 | Combustion products | 102 | Exhaust gas line |
| 40 | Fuel supply system | 104 | Exhaust gas heat exchanger |
| 42 | Fuel tank | 106 | Heat exchanger insert |
| 44 | Fuel pump | 110 | Accumulator temperature sensor |
| 46 | Fuel pressure regulator | 112 | Accumulator pressure sensor |
| 48 | Fuel control valve | 114 | Combustion temperature sensor |
| 50 | Fuel control valve actuator | 116 | Combustion pressure sensor |
| 52 | Fuel supply line | 118 | Crankshaft speed sensor |
| 53 | Fuel injection nozzle | 120 | Throttle position sensor |
| 54 | Intake manifold | 122 | Control computer |
| 56 | Intake valve | 124 | Electric storage battery |
| 58 | Left cylinder head | | |
| 60 | Intake valve actuator | | |
| 62 | Intake valve spring | | |
| 64 | Piston | | |
| 66 | Cylinder | | |
| 68 | Insulating air gap | | |
| 70 | Piston ring | | |

DESCRIPTION

FIG. 1—Heat Engine Schematic

A simplified view of the preferred embodiment of the heat engine is schematically illustrated in FIG. 1. An intake air filter 10 is located on the inlet of a compressor induction manifold 16 which is mounted on a compressor assembly 18. A compressed air supply manifold 20 connects compressor assembly 18 to an accumulator 22. A compressed air line 24 connects accumulator 22 to a combustion chamber 34, which adjoins an intake manifold 54, which in turn adjoins a cylinder 66. An exhaust manifold 100 also connects to cylinder 66. A crosshead shaft 72 passes out of cylinder 66 through a packing nut 78 and passes into a crosshead cylinder 84. A connecting rod 86 passes out of the opposite end of cylinder 84 and connects to a main crankshaft 88, which in turn is connected to a compressor crankshaft 92 via a compressor drive chain 90.

Figure 2:
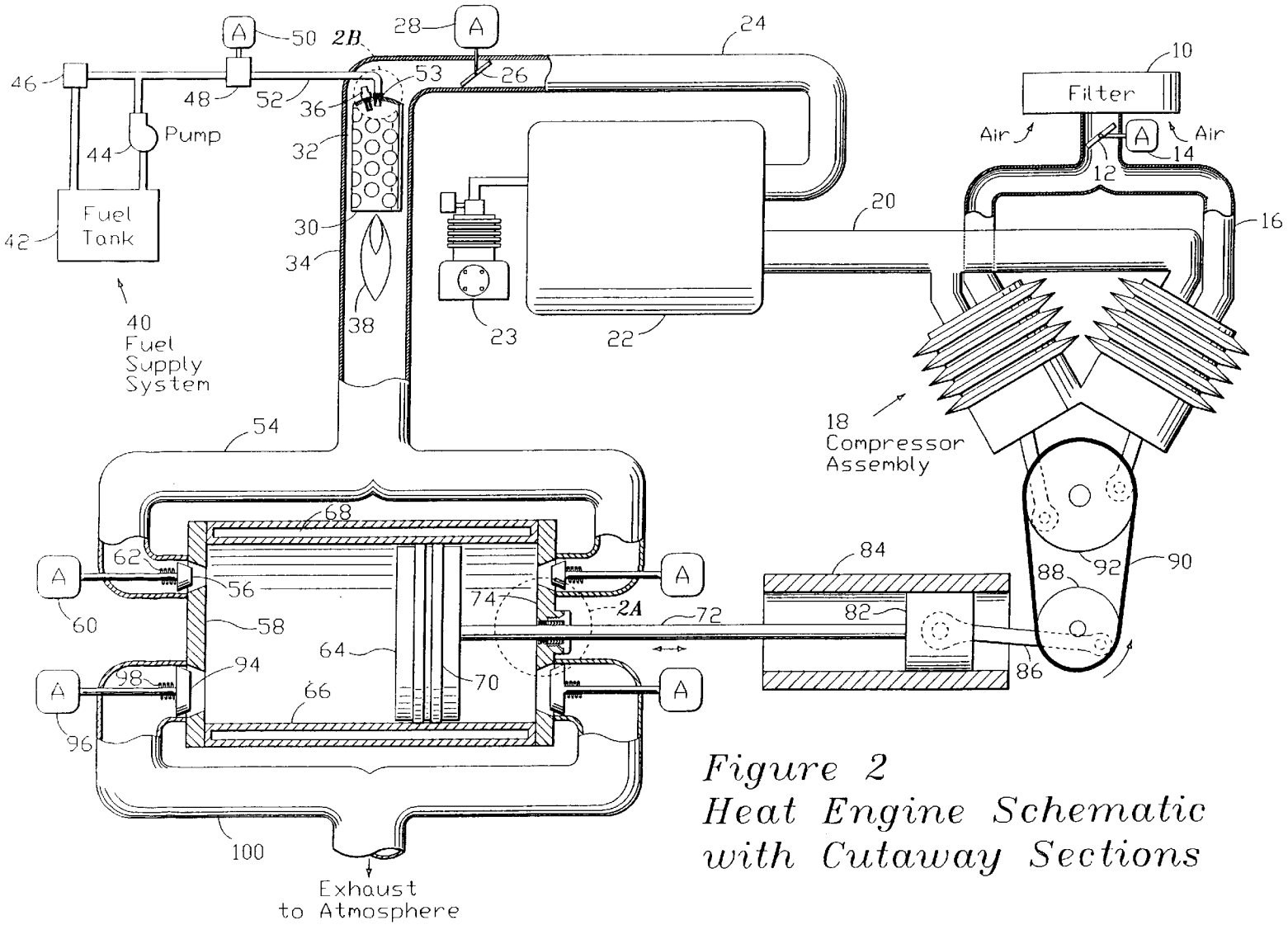
FIG. 2 is a schematic illustration including several cutaway sections.
Figure 2B:
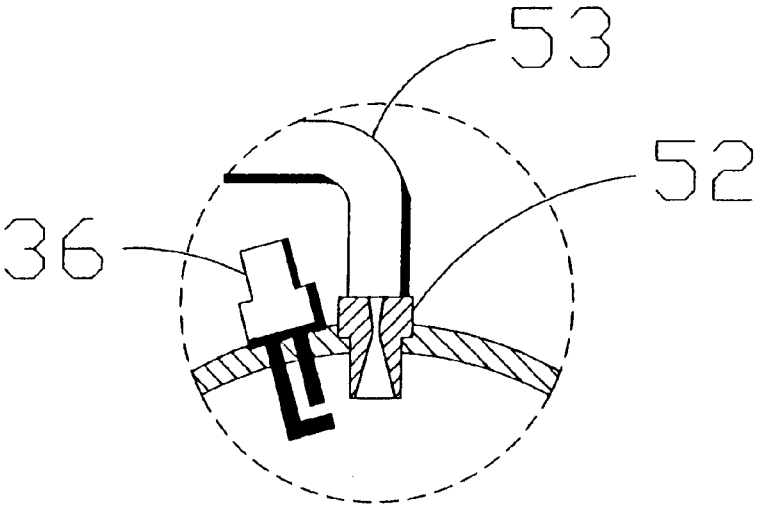
FIG. 2B is an enlarged detail of the fuel injection nozzle and ignition module.
Figure 2A:
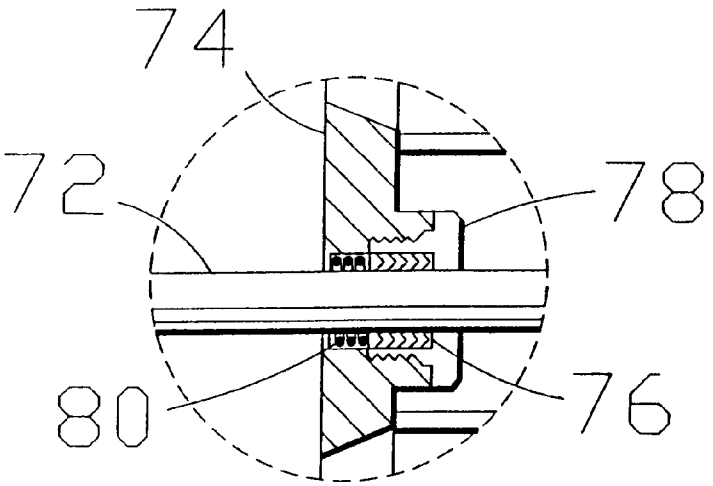
FIG. 2A is an enlarged detail of the crosshead shaft seal where the shaft penetrates the right cylinder head.

FIGS. 2, 2A, and 2B—Heat Engine Schematic With Cutaway Sections

FIG. 2 illustrates the same schematic view as FIG. 1 with some additional detail, including several cutaway sections. Intake air filter 10 is located on the inlet of compressor induction manifold 16 which is mounted on a compressor assembly 18. An induction valve 12, positioned by an induction valve actuator 14, is located near the inlet to manifold 16. Throughout FIGS. 2 and 3, the letter "A" is used to designate a suitable actuator.

Compressor 18 may be of any suitable positive displacement design. Since one skilled in the art could utilize an existing, conventional compression device, all of the details and internal parts of compressor 18 are not shown. The preferred embodiment illustrated in FIG. 2 is a conventional reciprocating piston compressor with cam driven, overhead poppet type valves. The use of induction valve 12 may be avoided by the use of any suitable cylinder unloading mechanism. Such techniques to idle individual cylinders are common practice in compressor construction. Multistage compression with interstage cooling would be advantageous to the thermodynamics of this power cycle, but the use of such must be weighed against the added complexity and additional cost. With regard to the goal of minimizing both complexity and cost, the preferred embodiment utilizes single stage compression as shown. However, the scope of this invention is not limited to any particular positive displacement mechanism or arrangement. An appropriate air or liquid cooling system should be employed as a part of compressor assembly 18 as a means to lower the assembly temperature as much as practical. FIG. 2 depicts a simple direct cooling system via finned surfaces on the compressor cylinders.

Compressor 18 discharges into compressed air supply manifold 20 which in turn is connected to an insulated compressed air accumulator 22. Also connected to accumulator 22 is an auxiliary compressor 23. Accumulator 22 discharges into compressed air line 24 inside of which is a throttle valve 26, positioned by a throttle valve actuator 28. Compressed air line 24 connects to combustion chamber 34. Located within combustion chamber 34 is a burner 30 with an electronic ignition module 36 and a fuel injection nozzle 53. Air may pass though burner 30 or may bypass burner 30 via a secondary air passage 32 surrounding burner 30. The preferred embodiment is similar to a small gas turbine combustion system. One skilled in the art could adapt the fuel burning components from a small aviation gas turbine engine to match the illustrated arrangement.

Fuel is provided to burner 30 by a fuel delivery system 40. One skilled in the art could utilize an existing, conventional, high pressure fuel system based upon a fuel tank 42 and a fuel pump 44. In the arrangement shown, a fuel pressure regulator 46 connects the discharge of fuel pump 44 with a return line to fuel tank 42. Also connected to the discharge of pump 44 is fuel control valve 48 and a fuel control valve actuator 50. Valve 48 is attached to a fuel supply line 52 which then terminates at burner 30 with a fuel injection nozzle 53. FIG. 2B is an enlargement of the top portion of burner 30, showing ignition module 36 and nozzle 53.

Combustion products 38, produced from the burnt fuel and compressed air mixture, pass through intake manifold 54 to multiple intake valves 56, which are positioned by intake valve actuators 60, and are seated against a left cylinder head 58 or a right cylinder head 74 by intake valve springs 62. Valves 56 may be poppet, rotary, sliding, or any suitable design. They are depicted here as electronically actuated poppet valves. Combustion products 38 flow through the cylinder heads 58 and 74 into an enclosed cylinder 66. The scope of this invention is intended to include any number of cylinders or banks of cylinders, each identical in form to cylinder 66. The preferred embodiment employs two or three cylinders laying flat, side by side. FIG. 2 shows a single cylinder for the purpose of illustration only. Cylinder 66 is fabricated to retain as much of the heat contained in combustion products 38 as is practical. To accomplish this, cylinder 66 is constructed of a suitable insulating material and with an insulating air gap 68. The preferred embodiment utilizes high temperature structural ceramics such as silicon nitride or silicon carbide on all components which are in the path of hot combustion products 38.

A piston 64 is located inside of cylinder 66 and will reciprocate left and right as directed by the pressurized combustion products 38. A seal is made between cylinder 66 and piston 64 by a set of piston rings 70. These piston rings 70 are fabricated from a durable material capable of withstanding the high temperatures involved while providing a low friction, dry lubrication, with cylinder 66. The preferred embodiment utilizes a low friction ceramic material. The absence of external lubrication and cooling components greatly simplifies this design and reduces parasitic losses when compared to conventional engines. The lack of required maintenance of conventional cooling and lubricating fluid reservoirs, which may be contaminated by combustion byproducts, is a considerable advantage.

Piston 64 is attached to crosshead shaft 72 which passes through right cylinder head 74 via a seal composed of a packing gland 76, a packing nut 78, and a packing spring 80 as shown in the enlarged view titled FIG. 2A, Crosshead Shaft Seal Detail. On the other end of crosshead shaft 72 is a crosshead piston 82 which reciprocates in crosshead cylinder 84. Crosshead piston 82 is attached to connecting rod 86 which in turn rotates main crankshaft 88. Counterbalances (not shown for simplicity of illustration) are used on crankshaft 88 to dynamically balance the entire reciprocating mass of piston 64, shaft 72, and piston 82. One skilled in the art would apply well established techniques to balance an engine with any number and arrangement of pistons.

Main crankshaft 88 produces a motive power which provides useful work while also driving compressor assembly 18. Compressor crankshaft 92 and main crankshaft 88 are permanently coupled in a fixed transmission ratio via a simple drive mechanism, illustrated here as compressor drive chain 90. A mechanism to vary the power delivery to compressor 18, or transmission ratio of such, is unnecessary due to the inherent variable loading capability of compressor 18. This simplification is a significant improvement over Johnson U.S. Pat. No. 4,653,269.

The motive power taken from crankshaft 88 may be utilized by one of many power take off means which are available to one skilled in the art. A simple one or two speed gear transmission may be used. Alternatively, the main crankshaft 88 may be permanently coupled to the drive axles due to the favorable torque characteristics of this powerplant. The use of a very simple power transmission or the elimination of such is a substantial reduction in cost, vehicle weight, and complexity over the conventional multi-gear transmissions with torque converters in use today.

Combustion products 38 exit cylinder 66 via multiple exhaust valves 94, which are positioned by exhaust valve actuators 96 and are seated against left cylinder head 58 or right cylinder head 74 by exhaust valve springs 68. Valves 68 may be poppet, rotary, sliding, or any suitable design. Exhaust valves 94 open to an exhaust manifold 100 which in turn discharges to the atmosphere.

Figure 3:
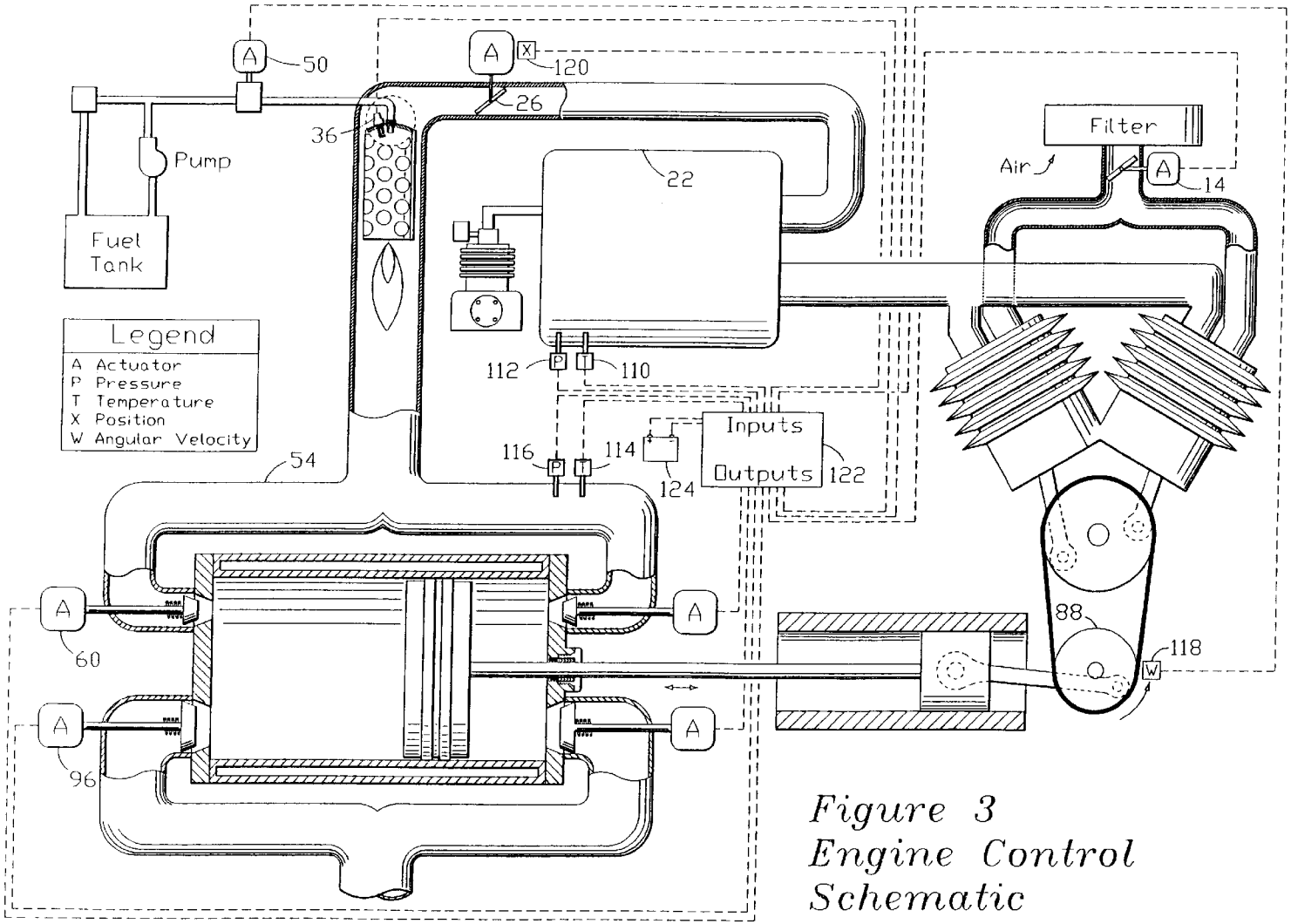
FIG. 3 is an engine control schematic showing the system computer, sensors, and actuators.

FIG. 3—Engine Control Schematic

An electronic, microprocessor based, engine control computer 122 is wired to a number of electronic sensors and actuators.

All commercially available, modern passenger vehicles employ microprocessor based, electronic engine control systems. These systems monitor engine operating conditions via numerous temperature, pressure, lambda (or oxygen), and mass flow sensors. Many electrically operated and pneumatic vacuum operated actuators are commonly employed. One skilled in the art of engine control would be able to select the appropriate sensors and actuators for the applications described below. Any number of devices will function with equal utility. The scope of this invention is not intended to be limited to any specific type of sensor, actuator, or control computer.

The following are sensory input connections to control computer 122:

Accumulator temperature sensor 110 and accumulator pressure sensor 112, both mounted on accumulator 22.

Combustion temperature sensor 114 and combustion pressure sensor 116, both mounted on intake manifold 54.

Crankshaft speed sensor 118, located adjacent to main crankshaft 88.

Throttle position sensor, adjacent to throttle valve 26.

Control computer 122 is also wired to the following controlled devices:

Induction valve actuator 14.

Fuel control valve actuator 50.

Intake valve actuators 60.

Exhaust valve actuators 96.

Electronic ignition module 36.

An electric storage battery 124 is wired to control computer 122.

FIG. 4—Partial Heat Engine Schematic With Exhaust Gas Heat Recovery

FIG. 4 illustrates the same arrangement in FIGS. 1, 2, and 3 with the addition of an exhaust gas heat exchanger 104. Exhaust manifold 100 connects heat exchanger 104 via an exhaust gas line 102. Compressed air supply manifold 20 also connects to heat exchanger 104 on the right and left sides. One skilled in the art would be familiar with many types of conventional heat exchangers and their application. The scope of this invention does not intend to be limited to any particular type of heat exchanging device.

FIG. 5—Partial Heat Engine Schematic With Exhaust Gas Heat Recovery Within the Accumulator FIG. 5 illustrates the same arrangement put forth in FIGS. 1, 2, and 3 with the addition of an exhaust gas heat exchanger 104 located within accumulator 22. Heat exchanger 104 may be a separate device, or accumulator 22 and heat exchanger 104 may be engineered to be one integral assembly. Such an assembly would serve as both a pressure vessel and heat exchanger. As in FIG. 4, exhaust manifold 100 connects heat exchanger 104 via an exhaust gas line 102. Compressed air supply manifold 20 connects to accumulator 22 as in FIGS. 1, 2, and 3. Such an arrangement would be very compact, requiring less of space in the engine compartment. One skilled in the art could modify any number of conventional heat exchanger designs to incorporate a pressure vessel, or accumulator 22. Once again, the scope of this invention does not intend to be limited to any particular type of heat exchanging device.

Operation

FIG. 2—Compression

Atmospheric air is drawn into intake air filter 10 by the suction of compressor assembly 18. This filtered air flow is proportionally varied according to the engine system needs by induction valve 12 and induction valve actuator 14. The control sequence for induction valve 12 will be described below under the heading "FIG. 3—Engine Control". Alternatively, if induction valve 12 is omitted and individual cylinder unloading is utilized, the pumping losses associated with throttled induction will be avoided. If full atmospheric air pressure is maintained at the suction to the compressor 18, the thermodynamic cycle efficiency will improve.

The filtered air is drawn through compressor induction manifold 16 into compressor 18 where it will be compressed to some fraction of its original volume. As the volumetric compression ratio increases, the thermodynamic efficiency and specific work output both increase. The volumetric compression ratio is defined as the ratio of maximum to minimum internal volume within cylinder 66 as piston 64 reciprocates from one extreme to the other. Theoretically, any increase in this compression ratio produces a corresponding increase in the cycle efficiency. However, in reality, as this compression ratio increases, the work consumed by compressor 18 also increases, as does the compressor 18 discharge air temperature. For the work output of an engine cycle to remain constant while the compression ratio is increased, the maximum cycle temperature would also need to be increased. This is the temperature occurring at the exit of combustion chamber 34. In addition, as the compression ratio increases, the back-work ratio (the ratio of work consumed by the compression to the work produced during expansion) becomes excessive.

Assuming a given volumetric compression ratio, there are two methods for lowering the compressor to expander back-work ratio. They are the use of multistage compression with interstage cooling and the use of an higher maximum cycle temperature as mentioned above. While the use of multistage compression is limited by the design goal of simplicity, the maximum cycle temperature is more strictly limited by the material properties of the high temperature engine components and the formation of oxides of with atmospheric nitrogen.

A suitable air or liquid cooling system should be employed to lower the temperature of compressor 18 as much as practical to enhance the system volumetric efficiency. The colder the filtered air remains during induction, the lower its specific volume will be. This would lead to a greater mass of air to be inducted per unit of compressor displacement. This is readily achieved due to the remote location of the combustion process. The such described cooling system is much smaller and less complex than would be needed to cool the expansion cylinder 66.

Following is a brief description of the procedure which was used to determine the most efficient engine operating parameters. First, the high temperature materials are chosen for use in the path of the hot combustion gases. Next, the highest possible temperature of combustion is determined with regard to limitations of the chosen materials. Using this temperature, a volumetric compression ratio is found which produces the maximum possible specific work output. (Specific work is work per unit of air mass flow.) These two parameters, maximum cycle temperature and volumetric compression ratio, along with a few assumptions, establish the entire engine thermodynamic cycle. A cycle analysis which assumes overall efficiencies of compression and expansion to be 85 percent and assumes a maximum cycle temperature of 1200 to 1500° C. (2160 to 2700° F.) produces a maximum specific work output using a compression ratio of approximately 6 to 8. When consideration is also given to the formation of oxides of nitrogen, a slightly lower combustion temperature may be required. This would affect the compression ratio selection. However, if a suitable reducing catalyst could be employed in an exhaust gas after-treatment system, the material limited temperatures described above will be feasible. The requirement of such a catalyst would be efficient operation in lean combustion environments. Research into this type of catalyst is rapidly advancing.

The thermodynamic cycle analysis mentioned above is one which will determine the physical properties of the engine power fluid as it moves through the powerplant. In this case, the power fluid is first atmospheric air and second the hot products of combustion. The initial state of the inducted air is known as "standard air", or 25° C. at 101 kPa. State 2 follows compression and is found using the volumetric compression ratio, an 85 percent efficiency of compression, and a small loss of heat during compression to the compressor 18 cooling system. The subsequent combustion is assumed to be isobaric. Therefore, state 3, which follows combustion, will be at the same pressure as state 2, but heated to the maximum cycle temperature. Exhaust, or state 4, follows expansion. This last state is found using the volumetric expansion ratio, an 85 percent efficiency of expansion, and a minimal loss of heat during expansion. The volumetric expansion ratio is assumed to be equal to the compression ratio. This is for ease of analysis only. One skilled in the art would determine an independent expansion ratio which would most fully expand the gases under the widest variety of operating conditions. The expansion ratio will likely be 10 to 20 percent larger than the compression ratio.

Compressed air is discharged into compressed air supply manifold 20 and conducted to insulated accumulator 22. Heat loss during the storage and transfer of compressed air will be minimized by appropriate heat insulating materials. Any loss of heat at this stage would necessitate an equal increase in heat to be added during the combustion stage.

The pressure of accumulator 22 will be maintained at a constant level, independent of the other engine subsystems, via the modulation of induction valve 12 by induction valve actuator 14, or by the unloading of compressor 18 cylinders. During part load operation, the combustion and expansion process will require less compressed air, therefore, proportionally less air will be inducted into compressor 18. This will proportionally reduce the compression "back-work" and increase part load efficiency. During deceleration, accumulator 22 will continue to charge. This may be viewed as a regenerative braking function. Once accumulator 22 is fully charged, the maximum amount of energy will be stored, and induction valve 12 will close, or the compressor 18 cylinders will be fully unloaded.

Much research and development work is being done with variable valve timing, individual cylinder idling, and other means to accomplish improved part load operation with conventional internal combustion engines. This design will inherently provide a simple and efficient part load sequence as well as a regenerative braking function.

This engine is inherently self starting due to the compressed air reserve contained in accumulator 22. No external starting device is required, for compressed air is instantaneously available upon demand. Accumulator 22 will be capable of sustaining its compressed air charge for an extended period of time. The addition of an auxiliary compressor 23 will provide a backup system for recharging accumulator 22. This may be required after an extremely long period of in-operation or in the case of a damaged and leaking accumulator 22.

FIG. 2—Combustion

Compressed air line 24 will conduct the compressed air upon demand to combustion chamber 34. Throttle valve 26 is positioned by throttle valve actuator 28 in order to vary the flow of the compressed air supply based on the demand for output power by the engine operator. Throttle valve actuator 28 would preferably be a conventional cable linkage which is manually actuated by the engine operator.

Compressed air flows into the base and sides of burner 30 along with a controlled amount of fuel, which is sprayed out of fuel injection nozzle 53. Fuel is delivered from tank 42 by pump 44 to fuel control valve 48. The fuel pressure on the pump side of valve 48 will be maintained at a constant level by regulator 46. This pressure will be set at a level slightly higher than that present within burner 30. As the fuel flow through valve 48 varies, regulator 46 will meter excess pressure back to tank 42. Both air and fuel are then ignited by a high voltage spark discharge produced by electronic ignition module 36.

A relatively constant pressure will be seen in the combustion chamber 34. Additional, excess compressed air is supplied via secondary air passage 32 providing complete combustion. The fuel supply is precisely controlled by the control computer 122 according to various operating parameters including combustion chamber exiting temperature and compressed air mass flow rate. The result is a semi-continuous combustion process with the benefit of excess air, continuing thought intake manifold 54. These relatively long passageways provide ample time for a complete and efficient combustion process and a corresponding absence of unburned hydrocarbons and carbon monoxide.

In any heat engine, the process of heat addition is of primary significance. More important than the quantity is the timing of heat addition. As seen in the conventional internal combustion engine, any heat released after the initiation of extraction of useful work will be only partial utilized at best. At worst, it will merely increase the energy of the exhaust stream. In the engine described here, all of the heat of combustion is released prior to any expansion of the combustion products, greatly enhancing the overall thermal efficiency.

Compressed air, and a corresponding amount of fuel will flow upon system demand from throttle valve 26. Therefore, when no power is required, flow and combustion will stop and re-ignition by ignition module 36 will be required once flow is again established. No idling is required do to the positive pressure of the stored compressed air supply in accumulator 22 which will instantly resume engine operation on demand. This will further reduce the system fuel consumption in intermittent, stop and go operation.

FIG. 2—Expansion

Multiple induction valves 56 intermittently allow passage of combustion products 38 into cylinder 66. Actuators 60 overcome the force of springs 62 which aid in the seating of valves 56 in left cylinder head 58 and right cylinder head 74. As the hot, pressurized combustion products 38 flow into cylinder 66, they expand and forcibly press against piston 64. The gases are prevented from blowing by piston 64 by low friction piston rings 70. Piston 64 will forcefully conduct this reciprocating motion to crosshead shaft 72 and crosshead 82 which in turn reciprocates in cylinder 84. Crosshead 82 constrains piston 64 to one axis of motion, eliminating the majority of bending and slapping forces acting on piston 64. Due to the low ductility of structural ceramic materials, it is advantageous to reduce such forces seen by these components. Durability and reliability of such an arrangement is much greater than the a less constrained configuration seen in conventional piston over oil sump designs. The elimination of a lubricating oil sump and its peripheral pump and filter is yet another reduction of parasitic power losses. In addition, many compact under-hood component configurations are possible without the need for an upright cylinder and oil sump arrangement. Lastly, the lack of such a sump is a major enhancement of system reliability and maintainability.

As piston 64 reaches the bottom of its stroke, exhaust valve actuator 96 will open exhaust valve 94 to allow the exit of combustion products 38. Exhaust valves 94 are seated against the cylinder heads 58 and 74 by springs 98. The exhausted gases pass through manifold 100 out to free air. A sound attenuation device, or muffler, will not be required due to the quiet, semi-continuous combustion process.

An alternate embodiment of this invention would utilize exhaust gas heat recovery. The expanded gases would pass from exhaust manifold 100 to a suitable heat exchanging device. Concurrently, the compressed air supply exiting compressor 18 would be routed through this heat exchanger prior to storage in accumulator 22. Some of the heat energy contained in the exhaust gases would be imparted to the newly compressed air. This technique is commonly employed in gas turbine powerplants.

Another alternate embodiment of this invention would be the utilization of an exhaust gas heat exchanger which is integral with accumulator 22. The compressed air side of the heat exchanger would be of sufficient volume to function as an accumulation device. These embodiments are further described below in the sections relating to FIGS. 4 and 5.

FIG. 2—Power Delivery

Crosshead 82 will rotate main crankshaft 88 via connecting rod 86. Crankshaft 88 will in turn rotate the compressor crankshaft 92 via compressor drive chain 90, and will also provide the a motive power to drive the vehicle. The favorable torque characteristics make possible the use of a very simple transmission. It is one of the design goals of this invention to eliminate the need for a wasteful and complicated torque converter coupled to a complex four to six speed gear box as seen on the majority of modern passenger vehicles. One skilled in the art of automotive powertrains could employ a suitable one to three speed transmission system to drive the vehicle wheels.

The scope of this invention is not limited to use as an automotive powerplant. The output of this engine may be adapted to a multitude of tasks. However, this design emphasizes that the torque output and operating characteristics are optimal for a motor driven vehicle. Instantaneous power, upon demand, smooth and forceful torque delivery, and quiet operation will delight the operator. The efficiency of combustion, fluid transfer, and thermodynamics will excite the engineer.

FIG. 3—Engine Control

Engine control computer 122 accepts a number of sensory inputs which monitor various engine operating conditions. A preprogrammed logic and control algorithm resides within control computer 122. Using this algorithm, computer 122 will respond to these inputs by manipulating the various valve actuators in order to maintain the proper engine operating conditions. Four independent control sequences are described below.

First, induction valve 12 will be positioned by induction valve actuator 14 in order to vary the flow of atmospheric air into compressor 18. Actuator 14 will respond in proportion to the pressure within accumulator 22 as sensed by accumulator pressure sensor 112. As the pressure within accumulator 22 rises, induction valve 12 will close in proportion. As the pressure within accumulator 22 falls, induction valve 12 will open in proportion. The pressure setpoint used by this control routine is that of state 2 from the above cycle analysis. State 2 is the steady state compressor 18 discharge temperature, determined by the volumetric compression ratio and the heat dissipated during compression. The compression ratio of 6 to 8, discussed above, would produce an accumulator 22 pressure setpoint of 1300 to 1900 kPa (190 to 280 psia).

During regenerative braking, the pressure within accumulator 22 will be allowed to rise to any safe level, restricted by the physical limitations of accumulator 22. This excess pressure becomes a reserve capacity, stored for later for use by burner 30.

Second, throttle valve 26 is positioned by throttle valve actuator 28. The position is manually adjusted by the engine operator in relation to the desired amount of output power from the powerplant. As throttle valve 26 opens, compressed air rushes through compressed air line 24 into burner 30 and secondary air passage 32. Throttle valve actuator 28 may be a mechanical linkage such as a manually operated cable or rod, or alternatively, actuator 28 may be an electronic device responsive to an electrically transmitted signal from the engine operator via control computer 122.

Third, fuel control valve 48 will be positioned by actuator 50 in order to vary the pressurized fuel supply to burner 30. Ideally, the fuel flow would be varied in direct proportion to the compressed air mass flow through throttle valve 26. The precise quantity of fuel is provided to maintain a desired fuel to air ratio. The essentially constant combustion process also provides the potential for lean fuel to air ratios and the resulting reduction in fuel consumption. A significant amount of research has been done in recent years to incorporate lean fuel to air ratios in internal combustion, spark ignition engines. This research has produced limited results due to the impulsive, harsh combustion environment seen in conventional internal combustion engines.

Due to the difficulty in directly sensing the mass flow of a high temperature, high pressure air stream, some other method may be employed to determine the actual flow. The preferred embodiment will empirically calculate the mass flow from the following measurable parameters:

- pre-throttle temperature as sensed by accumulator temperature sensor 110,
- pre-throttle pressure as sensed by accumulator pressure sensor 112,
- post combustion temperature as sensed by combustion temperature sensor 114,
- post combustion pressure as sensed by combustion pressure sensor 116,
- engine speed as sensed by crankshaft speed sensor 118,
- throttle position as sensed by throttle position sensor 120.

These inputs are continuously cross referenced with empirical data residing within control computer 122, and a corresponding mass flow is derived. Control computer 122 will perform this derivation many times each second. Each time the flow is seen to change, fuel control valve actuator 50 will modulate fuel control valve 48 as required to maintain the desired fuel to compressed air ratio.

Alternatively, if an accurate and cost effective sensor becomes available which will directly measure the compressed air flow rate, the use of such would be within the scope of this invention.

An alternate fuel control sequence consists of the direct measurement and then control of the temperature of combustion products 38 by combustion temperature sensor 114. Fuel control valve actuator 50 would modulate fuel control valve 48 in direct proportion to the rise and fall of this sensed temperature. The control setpoint would be the temperature of state 4, maximum cycle temperature, from the above cycle analysis.

Another embodiment of this control sequence would be as follows. The former, preferred sequence utilizing the mass flow/fuel air ratio control would be "fine tuned" by the addition of the latter sequence which directly utilizes the combustion temperature sensor 114.

The fourth independent control sequence is the timing of the opening and closing of intake valves 56 and exhaust valves 94. The most simple sequence consists of a fixed relationship between the positions of valves 56 and 94 and the position of piston 64, or the respective angular position of crankshaft 88. One skilled in the art would have an established understanding of this type of valve timing from the applications seen in conventional internal combustion engines. Using the left side of cylinder 66 for illustration, intake valve 56 will open when piston 64 is nearing its left-most position. At this point, the volume enclosed by cylinder 66 and piston 64 will be near minimum, and any residual gases within this volume will be compressed to a pressure equal to those on the combustion side of intake valve 56. The most effective instant in which valve 56 should open, as well as the duration of this opening, is determined by the following,

- the time required to fully open and then close valve 56 in relation to the speed of piston 64,
- the amount of residual gases within cylinder 66 from the last cycle of piston 64 and the resulting pressure differential across valve 56,
- the size of valve 56, or its respective orifice, and the resulting restriction to gas flow,
- the actual pressure of combustion products 38 at any given set of operating conditions,
- the volumetric expansion ratio produced by the action of cylinder 64 and piston 66,
- the load applied to the engine.

While a fixed valve timing is the most elegant and simple embodiment, compromises must be made in regard to the above factors. For example, under light loads, a slight opening of intake valve 56 would allow an appropriate amount of combustion products 38 into cylinder 64 which would then efficiently expand to near atmospheric pressure before being exhausted by exhaust valve 94. Under heavy loads, less attention may be given to efficiency, and a larger charge of combustion products 38 could be admitted. More power would be available from the higher average pressure working against piston 64 during the expansion, or power, stroke. The fixed expansion ratio which fully expands the smaller charge of combustion products 38 would not be sufficient to completely expand this larger charge. The energy contained in the under expanded exhaust products would be lost, with a corresponding reduction in system efficiency.

The actual pressure of combustion products 38 will vary according to the pressure drop across throttle valve 26 and the current pressure within accumulator 22. This will affect the pressure differential across intake valve 56. To maximize volumetric efficiency, the pressure on the cylinder side of intake valve 56 should never exceed the pressure on the combustion side of valve 56. If this were to occur at the time when valve 56 opens, a small amount of residual gas would pass out of cylinder 66 to the combustion side of intake valve 56. This pressure equalization back-flow would result in a net energy loss for the engine cycle. To alleviate such a possibility, exhaust valve 94 would remain open until the moment just before intake valve 56 opens.

The use of electronically operated solenoids for intake valve actuators 60 and exhaust valve actuators 96 makes available a wide range variable timing sequences. Due to the favorable torque characteristics of this engine, the transmission will be geared such that the operating speed will be substantially slower than that of conventional internal combustion engines. Therefore, over the life of an engine, relatively fewer valve actuations will be made and the use of such solenoids will be practical. The advantages of such a system must be weighed against the simplicity of a fixed, mechanically timed valve train. The scope of this invention is intended to cover either possibility.

A final function of control computer 122 will be to reinitiate the combustion process after a flame failure or after any intermission of compressed air flow.

FIG. 4—Partial Heat Engine Schematic With Exhaust Gas Heat Recovery

Exhaust gas heat recovery is the transfer of sensible heat energy from the spent exhaust gasses to the incoming compressed air supply. The available temperature difference between the exhaust gases and the compressed air supply is dependent upon the compression ratio and maximum cycle temperature. If the compression ratio is too large or the maximum cycle temperature is to low, the available temperature difference will not justify the added complexity of heat exchanger 104.

Any sensible energy imparted to the compressed air supply prior to combustion will reduce the required amount of fuel required to attain the desired maximum cycle temperature at the exit of burner 30. Exhaust gases are conducted from exhaust manifold 100 by exhaust gas line 102 to heat exchanger 104. Within heat exchanger 104, the exhaust gases come in intimate contact with an extended surface area of a heat conducting material which is simultaneously in intimate contact with the compressed air supply.

FIG. 5—Partial Heat Engine Schematic With Exhaust Gas Heat Recovery Within the Accumulator The operation of the heat exchanger insert 106 is identical to that of heat exchanger 104 illustrated in FIG. 4. The only difference is in its construction FIG. 5 depicts a heat exchanger device which is an integral part of accumulator 22. As the compressed air supply is stored in accumulator 22, any exhaust gas exiting through heat exchanger insert 106 would transfer a portion of its sensible heat energy the resident compressed air.

CONCLUSIONS AND RAMIFICATIONS

This powerplant is ideally suited to the requirements of a modern motor vehicle. All of the stated goals toward enhanced efficiency and usability were met in greater or lesser degrees. The reserve capacity of accumulator 22 produces the ideal torque response in relation to engine speed that is required by a motor vehicle. The resulting smooth, non-impulsive power delivery produces a quiet engine which is pleasing to operate. Variable loading capability of compressor 18 greatly reduces part load fuel consumption. External, semi-continuous combustion process produces relatively few emissions of incomplete combustion products and more fully extracts the potential heat energy from the fuel. The high temperatures seen prior to expansion and the accompanying lack of heat removal produce a very high thermodynamic efficiency. The lack of main cooling or lubrication sub-systems is a major simplification as well as an avoidance of any associated parasitic losses.

Alone, any one of the above advantages would be a considered a significant accomplishment. Together they produce a major advance in engine design.

While the above description contains many specifics, these should not be construed as limitations on the scope of this invention, but rather as an exemplification of one preferred embodiment thereof. Many other variations are possible. Accordingly, the scope of this invention should be determined not by the illustrated embodiment, but by the appended claims and their legal equivalents.

What is claimed is:

1. A heat engine comprising:

(a) a compression means for generating a compressed air supply, (b) a compressed air modulation means for varying the quantity of generation of said compressed air supply from said compression means, (c) an accumulator for receiving and storing said compressed air supply, (d) a combustion means, external from said compression means, (e) a means for supplying said combustion means with a pressurized, combustible fuel, (f) a flow control means, independent of said compressed air modulation means, for modulating the flow of products of said combustion means in response to engine load, (g) an expansion means, external from said compression means and said combustion means, for receiving and expanding products of said combustion means and for producing a rotational work output, (h) a power take off means for connecting a portion of said rotational work output to propel an external task, (i) a permanent coupling means communicating a portion of said rotational work output to said compression means, (h) a pressure control means comprising an accumulator pressure sensing device in communication with said accumulator, a control computer, and a means to actively manipulate said compressed air modulation means for maintaining a given pressure within said accumulator means, (g) a temperature control means comprising a temperature sensing device located at the exit of said combustion means, and a means to actively control said fuel supply means in order to maintain a desired combustion product temperature at the location of said temperature sensing device.

2. The heat engine in claim 1 wherein an exhaust gas heat exchanger comprising an exhaust gas passage through said accumulator, and a means to conduct sensible heat from said exhaust gas passage to said compressed air supply.

3. The heat engine in claim 1 wherein said accumulator, said combustion means, and said expansion means are insulated against loss of heat.

4. The heat engine in claim 1 wherein the said expansion means consists of one or more pistons within one or more enclosed cylinders.

5. The heat engine in claim 4 wherein said pistons are connected to said power take off means by one or more crosshead members, which actuate in only one dimension, within one or more crosshead guides.

* * * * *